US012534316B2

(12) United States Patent
Kohara

(10) Patent No.: US 12,534,316 B2
(45) Date of Patent: Jan. 27, 2026

(54) SHEET FEEDER

(71) Applicant: Satoshi Kohara, Tokyo (JP)

(72) Inventor: Satoshi Kohara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 142 days.

(21) Appl. No.: 18/499,473

(22) Filed: Nov. 1, 2023

(65) Prior Publication Data

US 2024/0166457 A1 May 23, 2024

(30) Foreign Application Priority Data

Nov. 18, 2022 (JP) ..... 2022-184956

(51) Int. Cl.
*B65H 1/04* (2006.01)
*B65H 1/14* (2006.01)
(Continued)

(52) U.S. Cl.
CPC ..... *B65H 1/04* (2013.01); *B65H 1/14* (2013.01); *B65H 3/128* (2013.01); *B65H 3/48* (2013.01);
(Continued)

(58) Field of Classification Search
CPC . B65H 1/04; B65H 1/14; B65H 3/128; B65H 3/48; B65H 3/66; B65H 7/00; B65H 7/02; B65H 11/005; B65H 2405/112; B65H 2405/114; B65H 2405/1144; B65H 2511/12
See application file for complete search history.

(56) References Cited

U.S. PATENT DOCUMENTS 6,305,281 B1 10/2001 Aizawa
2010/0038843 A1* 2/2010 Marasco ..... B65H 7/00 271/152
(Continued)

FOREIGN PATENT DOCUMENTS

JP 2000-127594 A 5/2000
JP 2004-123396 A 4/2004
(Continued)

*Primary Examiner* — Prasad V Gokhale
(74) *Attorney, Agent, or Firm* — Harness, Dickey & Pierce, P.L.C.

(57) ABSTRACT

A sheet feeder includes a lift table, a first sheet-side restricting member, a second sheet-side restricting member, a suction conveyor, a rear-end restricting member, an upper distance-measuring sensor, a lower distance-measuring sensor, and processing circuitry. The first sheet-side restricting member and the second sheet-side restricting member restrict first ends and second ends opposite to the first ends, respectively, of sheets. The suction conveyor sucks and conveys a sheet floated. The rear-end restricting member restricts the sheets from moving in a longitudinal direction of the sheets. The upper distance-measuring sensor and the lower distance-measuring sensor measure a first distance and a second distance, respectively, to the first sheet-side restricting member or the second sheet-side restricting member. The processing circuitry compares measurement results of the first distance and the second distance to determine whether a distance between the first sheet-side restricting member and the second sheet-side restricting member is adequate.

6 Claims, 11 Drawing Sheets

(51) Int. Cl.

| | |
|---|---|
| ***B65H 3/12*** | (2006.01) |
| ***B65H 3/48*** | (2006.01) |
| ***B65H 3/66*** | (2006.01) |
| ***B65H 7/02*** | (2006.01) |

(52) U.S. Cl.
CPC ..... *B65H 3/66* (2013.01); *B65H 7/02* (2013.01); *B65H 2405/112* (2013.01); *B65H 2405/114* (2013.01); *B65H 2511/12* (2013.01)

(56) References Cited

U.S. PATENT DOCUMENTS

| | | | | |
|---|---|---|---|---|
| 2020/0299089 | A1* | 9/2020 | Matsui ..... | B65H 7/16 |
| 2022/0324670 | A1 | 10/2022 | Yamamoto et al. | |
| 2023/0150787 | A1* | 5/2023 | Ebihara ..... | B65H 31/20 270/1.01 |
| 2023/0234802 | A1 | 7/2023 | Kohara | |

FOREIGN PATENT DOCUMENTS

| | | | |
|---|---|---|---|
| JP | 2020-070166 | A | 5/2020 |
| JP | 2021-008353 | A | 1/2021 |

* cited by examiner

SHEET FEEDER

CROSS-REFERENCE TO RELATED APPLICATIONS

This patent application is based on and claims priority pursuant to 35 U.S.C. § 119(a) to Japanese Patent Application No. 2022-184956, filed on Nov. 18, 2022, in the Japan Patent Office, the entire disclosure of which is hereby incorporated by reference herein.

BACKGROUND

Technical Field

Embodiments of the present disclosure relate to a sheet feeder.

Related Art

A sheet feeder is known that floats a sheet by air and sucks and conveys the sheet by a suction belt. In such a sheet feeder, desirably, clearances between restricting members to support stacked sheets in the width direction of the sheets and lateral sides of the sheets are adequate to stabilize feeding and conveyance of the sheets. In such a sheet feeder, a technology is employed that detects the time needed for a sheet to float to determine whether clearances between restricting members to support stacked sheets in the width direction of the sheets and the lateral sides of the sheets are adequate.

SUMMARY

In an embodiment of the present disclosure, a sheet feeder according to a first aspect includes a lift table on which sheets are stacked, a first sheet-side restricting member, a second sheet-side restricting member, a suction conveyor, a rear-end restricting member, an upper distance-measuring sensor, a lower distance-measuring sensor, and processing circuitry. The lift table is movable in a vertical direction. The first sheet-side restricting member restricts first ends of the sheets stacked on the lift table in a width direction of the sheets. The second sheet-side restricting member restricts second ends of the sheets opposite to the first ends of the sheets in the width direction of the sheets. The suction conveyor sucks and conveys a sheet floated from the lift table after the lift table is lifted. The rear-end restricting member is disposed at a center portion of the sheets in the width direction of the sheets, to restrict the sheets stacked on the lift table from moving in a longitudinal direction of the sheets. The upper distance-measuring sensor is disposed at an upper portion of the rear-end restricting member, to measure a first distance to the first sheet-side restricting member or the second sheet-side restricting member. The lower distance-measuring sensor is disposed at a lower portion of the rear-end restricting member, to measure a second distance to the first sheet-side restricting member or the second sheet-side restricting member. The processing circuitry compares a measurement result of the first distance with a measurement result of the second distance to determine whether a distance between the first sheet-side restricting member and the second sheet-side restricting member is adequate.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
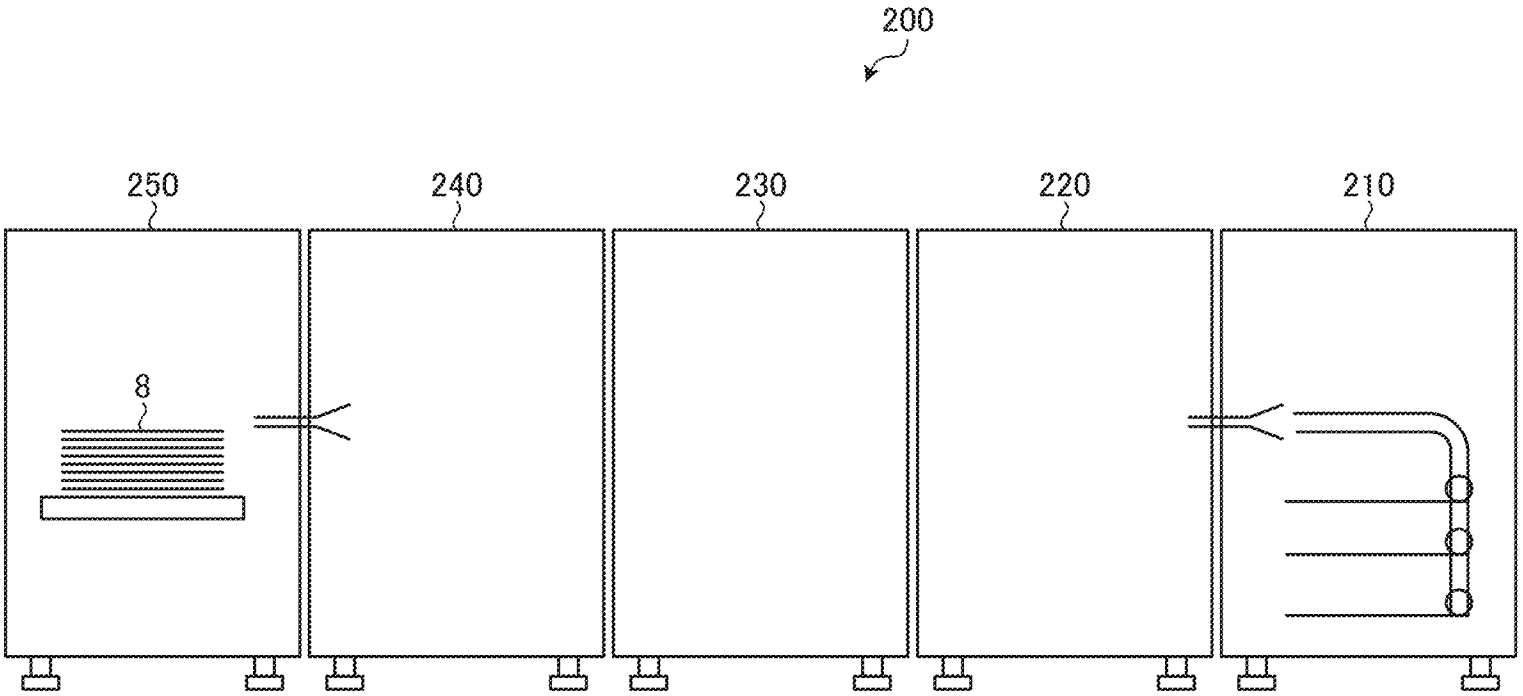
FIG. 1 is a diagram illustrating a configuration of an image forming system including a sheet feeder according to a first embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A sheet feeder according to embodiments of the present disclosure is described in detail with reference to the accompanying drawings in the following description.

First Embodiment

FIG. 1 is a diagram illustrating a configuration of an image forming system 200 including a sheet feeder 210 according to a first embodiment of the present disclosure.

As illustrated in FIG. 1, the image forming system 200 according to embodiments of the present disclosure includes the sheet feeder 210, a pretreatment-liquid application apparatus 220, an inkjet printer 230, a drier 240, and a sheet ejector 250.

The image forming system 200 sends a recording medium 8 such as a sheet of paper conveyed from the sheet feeder 210 to the pretreatment-liquid application apparatus 220. The pretreatment-liquid application apparatus 220 applies a pretreatment liquid to the recording medium 8 to enhance image quality such as for prevention of ink bleeding and assistance of ink permeation. The pretreatment-liquid application apparatus 220 applies the pretreatment liquid to the front side, the back side, or both sides of the recording medium 8.

The sheet feeder 210 supplies the recording medium 8 such as a cut sheet to the pretreatment-liquid application apparatus 220 disposed downstream from the sheet feeder 210 in a conveyance path of the recording medium 8. As described below, the pretreatment-liquid application apparatus 220 applies the pretreatment liquid, which prevents, for example, bleeding and bleed-through of inkjet ink printed on the recording medium 8, to the recording medium 8. The pretreatment-liquid application apparatus 220 includes a reverse path. In the case of duplex printing, after the pretreatment-liquid application apparatus 220 has applied the pretreatment liquid to the front side of the recording medium 8, the pretreatment-liquid application apparatus 220 reverses the recording medium 8 and applies the pretreatment liquid to the back side of the recording medium 8.

The inkjet printer 230 discharges ink droplets to the front side of the recording medium 8 to which the pretreatment liquid has been applied by the pretreatment-liquid application apparatus 220 to form a desired image. The drier 240 includes a drying device and dries the image on the front side of the recording medium 8, formed by the inkjet printer 230. When printing is performed on the front and back sides of the recording medium 8, the recording medium 8 is reversed along a path on which the recording medium 8 returns from the drier 240 back to the inkjet printer 230. Then, the inkjet printer 230 discharges ink droplets onto the front side, which is the back side of the recording medium 8 before the recording medium 8 is reversed, of the recording medium 8 to form a desired image. Subsequently, the drier 240 dries the image on the front side, which is the back side of the recording medium 8 before the recording medium 8 is reversed, of the recording medium 8. Then, the recording medium 8 is ejected to the sheet ejector 250.

Figure 2B:
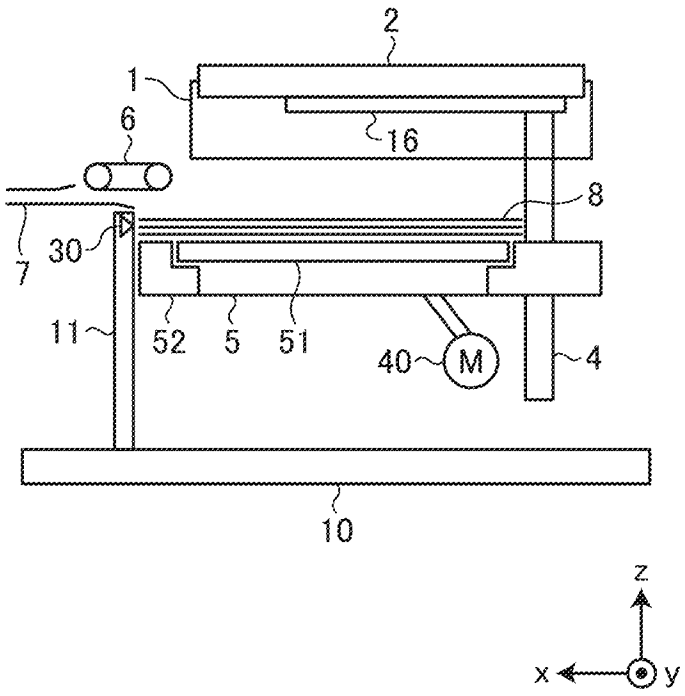
FIG. 2A and FIG. 2B are diagrams each illustrating a sheet tray of the image forming system of FIG. 1, viewed from the longitudinal direction of recording media, according to the first embodiment of the present disclosure.
Figure 2A:
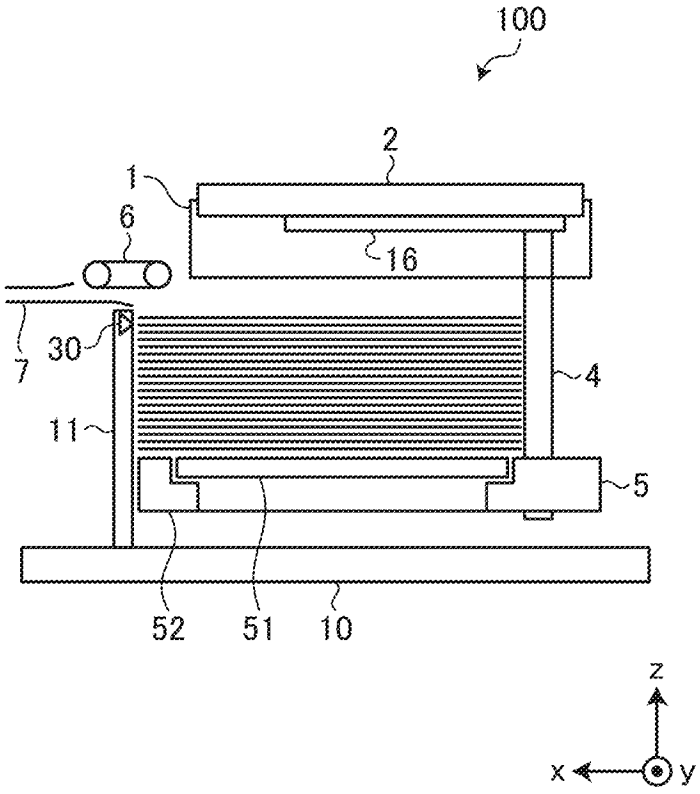

FIG. 2A and FIG. 2B are diagrams each illustrating a sheet tray 100 of the image forming system 200, viewed from the longitudinal direction of the recording media 8, according to the first embodiment of the present disclosure.

The sheet tray 100 provided for the sheet feeder 210 includes a lift table 5 movable in a vertical direction in FIGS. 2A and 2B by a lifting motor 40 and recording media 8 such as sheets of paper are stacked on the lift table 5. In other words, the lift table 5 serves as a lift table on which the recording media 8 such as sheets of paper are stacked and that is movable in the vertical direction. The lift table 5 includes bottom-surface supports 51 to support the bottom of the recording media 8 and a tip-end bottom-side support 52 to support the bottom of the tip end of the recording media 8. The lift table 5 is moved in the vertical direction by the lifting motor 40 and is controlled by a sensor such that the upper surface of an uppermost recording medium 8 is positioned at a predetermined position.

The recording media 8 are stacked such that downstream ends of the recording media 8 in the longitudinal direction of the recording media 8 contact a front-side plate 11. Upstream ends of the recording media 8 in the longitudinal direction of the recording media 8 are pressed against a rear-end restricting member 4 to be aligned along the rear-end restricting member 4. In other words, the rear-end restricting member 4 serves as a rear-end restricting member that restricts the recording media 8, which are stacked on the lift table 5, from moving in the longitudinal direction. The rear-end restricting member 4 is disposed at a center portion of the recording medium 8 in the width direction. The rear-end restricting member 4 is coupled to a guide rail 16. The guide rail 16 is fixed to a guide frame 2. The rear-end restricting member 4 is movable in the longitudinal direction of the recording medium 8 and is fixed with the upstream ends of the recording media 8 in the longitudinal direction of the recording medium 8 pressed against the front-side plate 11. The amount of movement of the rear-end restricting member 4 corresponds to the size of the recording media 8 in the longitudinal direction, which is the size of the sheets of paper in the longitudinal direction, stacked on the sheet tray 100. The range of the amount of movement of the rear-end restricting member 4 is set in accordance with the size of the recording media 8 in the longitudinal direction.

When a printing operation is started in the image forming system 200, the sheet feeder 210 blows air from an air nozzle 30 attached to the front-side plate 11 to cause an uppermost recording medium 8 to float up to the vicinity of a pickup belt 6 to a position upstream in the longitudinal direction of the recording media 8. Multiple holes are formed in the pickup belt 6, and air is sucked into the multiple holes by a fan.

Accordingly, the recording medium 8 floated by the air blown out from the air nozzle 30 is attracted to the pickup belt 6 and is ejected in a direction toward a guide plate 7 with the movement of the pickup belt 6. In other words, the pickup belt 6 and the air nozzle 30 serve as a suction conveyor that conveys the recording medium 8 floated from the lift table 5 after the lift table 5 has been lifted.

When the recording medium 8, which floats from downstream to upstream in the conveyance path of the recording medium 8 by the air blown from the air nozzle 30, is excessively floated by air, the recording medium 8 may be folded and wrinkled. For this reason, multiple sheet-pressing guides 1 are attached to the guide frame 2 in the longitudinal direction of the recording medium 8.

Figure 3B:
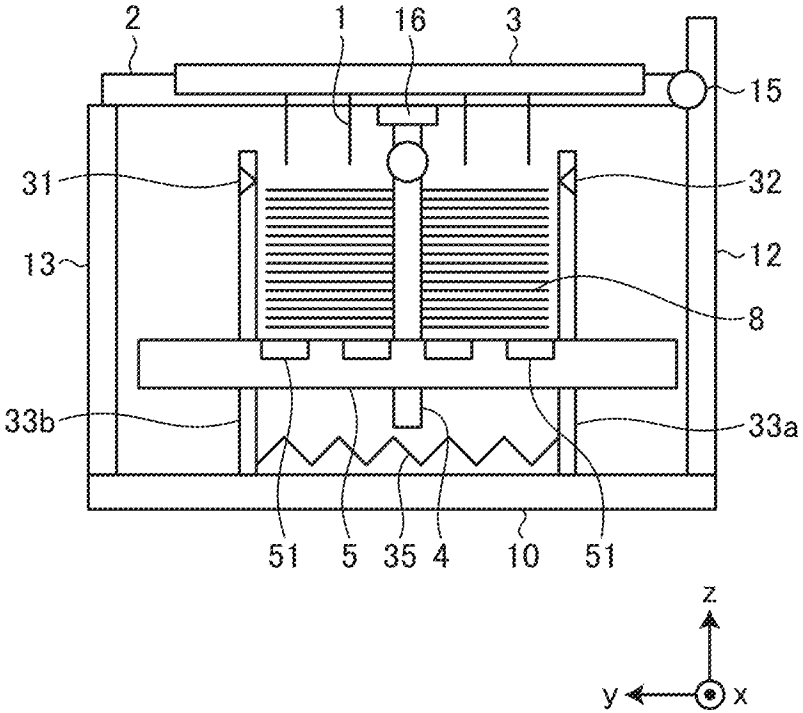
FIG. 3A and FIG. 3B are diagrams each illustrating the sheet tray of FIGS. 2A and 2B, viewed from the lateral direction of the recording media.
Figure 3A:
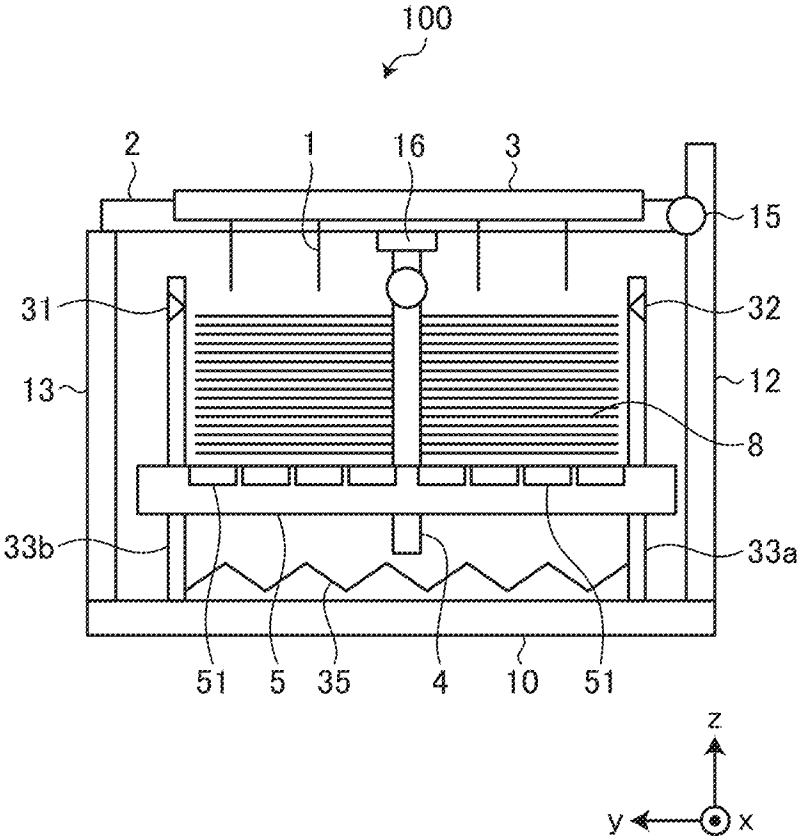

FIG. 3A and FIG. 3B are diagrams each illustrating the sheet tray 100 of the image forming system 200, viewed from the lateral direction of the recording media 8, according to the first embodiment of the present disclosure.

In the present embodiment, the sheet tray 100 of the sheet feeder 210 has a box-shaped structure formed with a left-side plate 13 and a right-side plate 12 attached to the bottom plate 10. In the box-shaped structure, for example, the lift table 5 and the rear-end restricting member 4 are disposed.

The guide frame 2 is attached to the right-side plate 12 via a hinge 15 to rotate about the hinge 15. The multiple sheet-pressing guides 1 are attached to the guide frame 2 and are fixed at given positions in accordance with the width of the recording media 8. A right sheet-side restricting member 33*a* and a left sheet-side restricting member 33*b* are attached to the right side and left side, respectively, of the lift table 5. The positions of the right sheet-side restricting member 33*a* and the left sheet-side restricting member 33*b* are moved in accordance with the recording media 8 set on the lift table 5.

The right sheet-side restricting member 33*a* and the left sheet-side restricting member 33*b* are moved in conjunction with each other by a coupler 35. Specifically, the right sheet-side restricting member 33*a* serves as a first sheet-side restricting member that restricts ends of the recording media 8 on one side in the width direction, which are stacked on the lift table 5. Those ends of the recording media 8 on one side are examples of the first ends of recording media. The left sheet-side restricting member 33*b* serves as a second sheet-side restricting member that restricts the other ends of the recording media 8 on the other side, which are stacked on the lift table 5. Those other ends of the recording media 8 on the other side are examples of the second ends of the recording media. The right sheet-side restricting member 33*a* and left sheet-side restricting member 33*b* are disposed to be movable in conjunction with each other in the width direction of the recording media 8. The multiple bottom-surface supports 51 placed on the lift table 5 are removably attached to the lift table 5 in accordance with the width of the recording medium 8 and slidable in the width direction of the recording media 8. The right sheet-side restricting member 33*a* and the left sheet-side restricting member 33*b* include multiple air nozzles 32 and 31, respectively. When the image forming system 200 starts a printing operation, air is blown out from the air nozzles 31 and 32. Accordingly, in the printing operation of the image forming system 200, several upper sheets of the recording media 8 may float as a whole, and the floated sheets of the recording media 8 are restricted by the sheet-pressing guides 1 and held at a constant height.

Figure 4B:
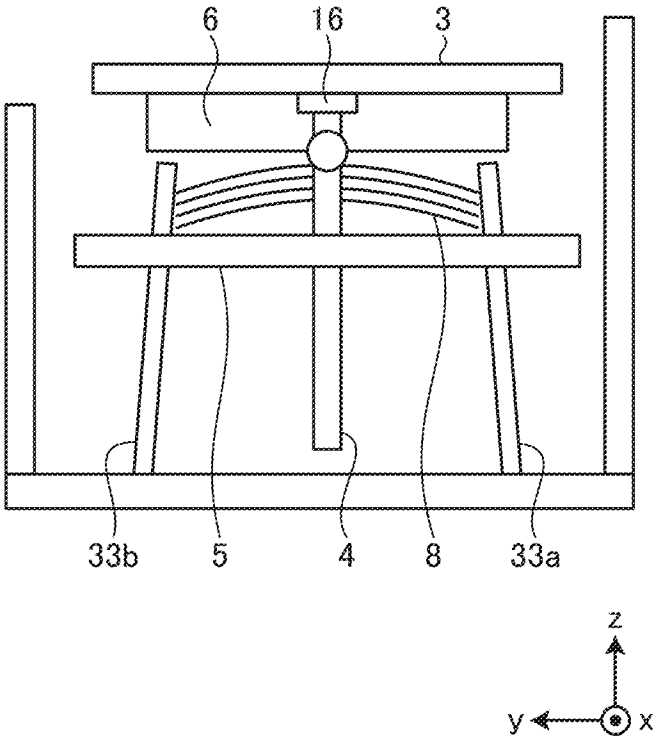
FIG. 4A and FIG. 4B are diagrams each illustrating the sheet tray of FIGS. 2A and 2B, viewed from the lateral direction of the recording media.
Figure 4A:
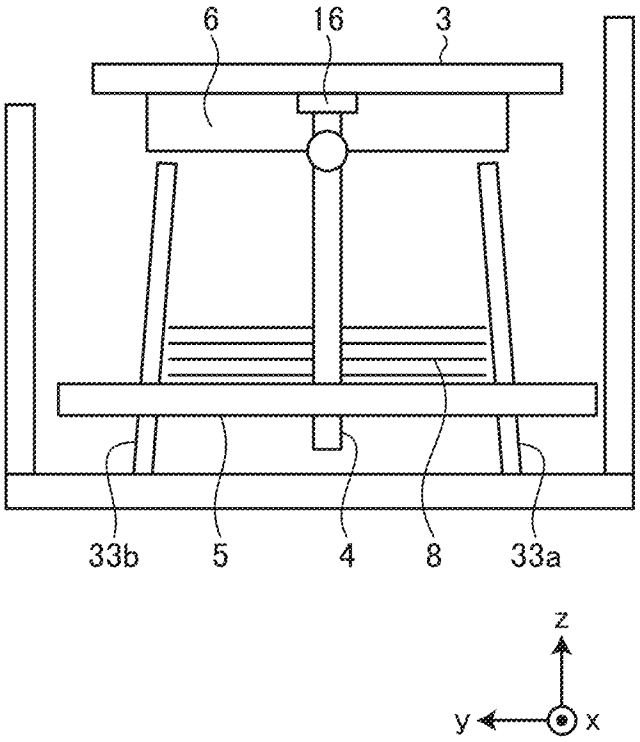

FIG. 4A and FIG. 4B are diagrams each illustrating the sheet tray 100 of the image forming system 200, viewed from the lateral direction of the recording media 8, according to the first embodiment.

Specifically, FIGS. 4A and 4B are diagrams each illustrating how feeding of the recording media 8 is influenced when the right sheet-side restricting member 33*a* and the left sheet-side restricting member 33*b* are inclined. When the right sheet-side restricting member 33*a* and the left sheet-side restricting member 33*b* are moved in accordance with the recording media 8 stacked on the lift table 5, clearances between the right sheet-side restricting member 33*a* and the left sheet-side restricting member 33*b* and lateral sides of the recording media 8 are adjusted to be adequate. However, due to, for example, the influence of the inclination of the right sheet-side restricting member 33*a* and the left sheet-side restricting member 33*b* or rattling of an operation mechanism of the sheet tray 100, the clearances between the right sheet-side restricting member 33*a* and the left sheet-side restricting member 33*b* and the lateral sides of the recording media 8 may not be adequately secured after the lift table 5 is lifted to the vicinity of the pickup belt 6.

When the inclination of the right sheet-side restricting member 33*a* and the left sheet-side restricting member 33*b* is large, the clearances between the right sheet-side restricting member 33*a* and the left sheet-side restricting member 33*b* and the lateral sides of the recording media 8 may be narrower than the size of the recording media 8 in the width direction after the lift table 5 is lifted to the vicinity of the pickup belt 6. Accordingly, the right sheet-side restricting member 33*a* and the left sheet-side restricting member 33*b* may be pressed against the lateral sides of the recording media 8. In particular, when sheets of thick paper each having a large basis weight, which is an example of the recording media 8, are employed and the lift table 5 is lifted, the clearances between the right sheet-side restricting member 33*a* and the left sheet-side restricting member 33*b* and the lateral sides of recording media 8 may become narrow. In such cases, the friction between the right sheet-side restricting member 33*a* and the left sheet-side restricting member 33*b* and the lateral sides of the recording media 8 may increase when the recording media 8 is floated and sucked and conveyed, which may cause a sheet feeding failure. In a method in which whether the clearances between the right sheet-side restricting member 33*a* and the left sheet-side restricting member 33*b* and the lateral sides of the recording media 8 are adequate is determined after lifting of the recording media 8 is started, the clearances between the right sheet-side restricting member 33*a* and the left sheet-side restricting member 33*b* and the lateral sides of the recording media 8 are readjusted after the operation of the image forming system 200 which is in operation is stopped. Accordingly, the time to start over the operation is long.

Figure 5B:
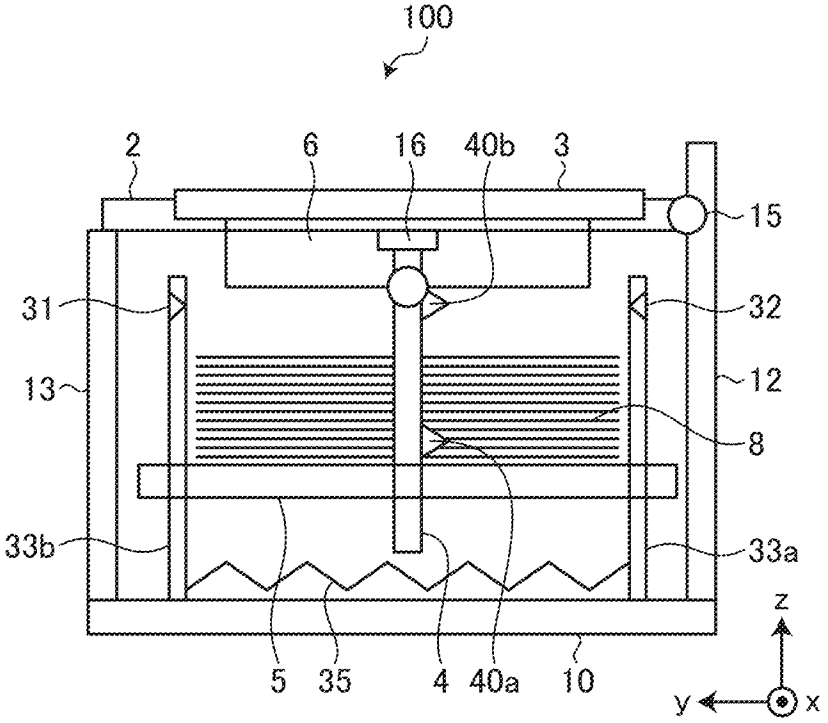
FIG. 5B is a diagram illustrating the relative positions of a left sheet-side restricting member and a right sheet-side restricting member and distance-measuring sensors in the sheet tray of FIG. 5A, viewed from the longitudinal direction of the recording media.
Figure 5A:
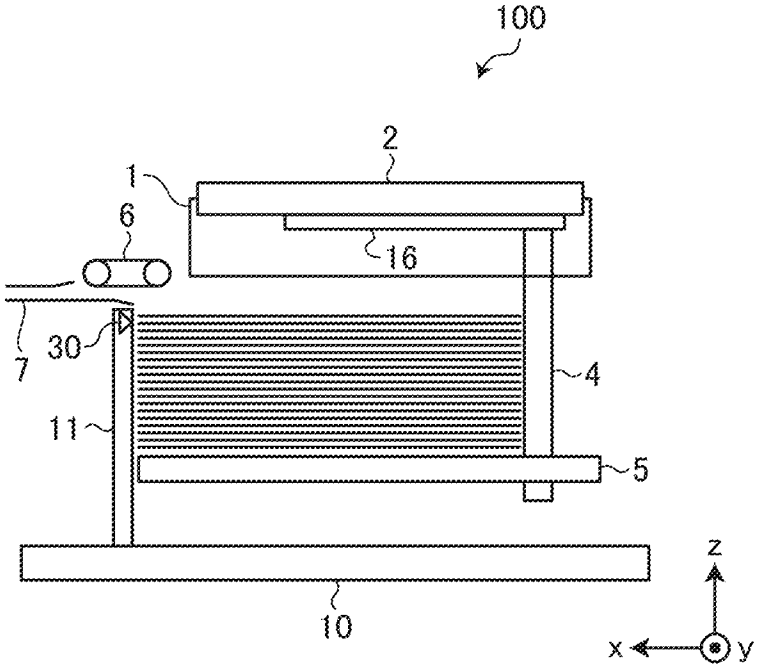
FIG. 5A is a diagram illustrating the sheet tray of FIGS. 2A and 2B, viewed from the longitudinal direction of the recording media.

FIG. 5A is a diagram illustrating the sheet tray 100 of the image forming system 200, viewed from the longitudinal direction of the recording media 8, according to the first embodiment of the present disclosure. FIG. 5B is a diagram illustrating the relative positions of the right sheet-side restricting member 33*a* and the left sheet-side restricting member 33*b* and distance-measuring sensors 40*a* and 40*b* in the sheet tray 100 of the image forming system 200, according to the first embodiment of the present disclosure.

In the present embodiment, the sheet feeder 210 includes a lower distance-measuring sensor 40*a* and an upper distance-measuring sensor 40*b* at a lower portion and an upper portion, respectively, of the rear-end restricting member 4 disposed at the center of the lift table 5 in the width direction of the recording media 8. The lower distance-measuring sensor 40*a* and the upper distance-measuring sensor 40*b* measure distances to the right sheet-side restricting member 33*a* and the left sheet-side restricting member 33*b*.

Specifically, the upper distance-measuring sensor 40*b* is disposed at the upper portion of the rear-end restricting member 4 and serves as an upper distance-measuring sensor that measures a first-measurement value that is an example of a first distance, which is the distance to the right sheet-side restricting member 33*a* or to the left sheet-side restricting member 33*b*. The lower distance-measuring sensor 40*a* is disposed at the lower portion of the rear-end restricting member 4 and serves as a lower distance-measuring sensor to measure a second-measurement value that is an example of a second distance, which is the distance to the right sheet-side restricting member 33*a* or the left sheet-side restricting member 33*b*. In the present embodiment, desirably, the upper distance-measuring sensor 40*b* is disposed at a height similar to the height at which the pickup belt 6 is disposed. The lower distance-measuring sensor 40*a* is disposed at a height in the vicinity of the upper surface of the lift table 5 when the lift table 5 is lowered to the lowest position.

After the recording media 8 are stacked and the positions of the right sheet-side restricting member 33*a* and the left sheet-side restricting member 33*b* and the rear-end restricting member 4 are adjusted, the sheet feeder 210 compares the measured values of the upper distance-measuring sensor 40*b* and the lower distance-measuring sensor 40*a* before lifting operation of the lift table 5 is started. When the first-measurement value measured by the upper distance-measuring sensor 40*b* is smaller than the second-measurement value measured by the lower distance-measuring sensor 40*a*, the sheet feeder 210 determines that the distance between the right sheet-side restricting member 33*a* and the left sheet-side restricting member 33*b* in the vicinity of the pickup belt 6 is narrower than the size of the recording media 8 in the width direction. In this case, the sheet feeder 210 displays an alert to request readjustment of the distance between the right sheet-side restricting member 33*a* and the left sheet-side restricting member 33*b* such that the distance between the right sheet-side restricting member 33*a* and the left sheet-side restricting member 33*b* is widened.

Whether the distance between the right sheet-side restricting member 33*a* and the left sheet-side restricting member 33*b* in the vicinity of the pickup belt 6 is adequate may be determined using the sheet width of the recording media 8 set in advance by an operator, which is referred to as sheet-width size in the following description, in addition to the measured values measured by the upper distance-measuring sensor 40*b* and the lower distance-measuring sensor 40*a*. More specifically, even when the first-measurement value measured by the upper distance-measuring sensor 40*b* is smaller than the second-measurement value measured by the lower distance-measuring sensor 40*a*, the sheet feeder 210 may not display the alert to request readjustment to widen the distance between the right sheet-side restricting member 33*a* and the left sheet-side restricting member 33*b* when the first-measurement value measured by the upper distance-measuring sensor 40*b* is greater than the sheet-width size set in advance.

As a result, the distance between the right sheet-side restricting member 33*a* and the left sheet-side restricting member 33*b* at a position at which the recording media 8 are sucked and conveyed is adequately secured. Accordingly, the recording media 8 can be fed and conveyed in a stable manner. Whether the distance between the right sheet-side restricting member 33*a* and the left sheet-side restricting member 33*b* is adequate can be determined before the lift table 5 is lifted. Accordingly, the time to start over the operation can be minimized when the distance between the right sheet-side restricting member 33*a* and the left sheet-side restricting member 33*b* is readjusted.

Figure 6:
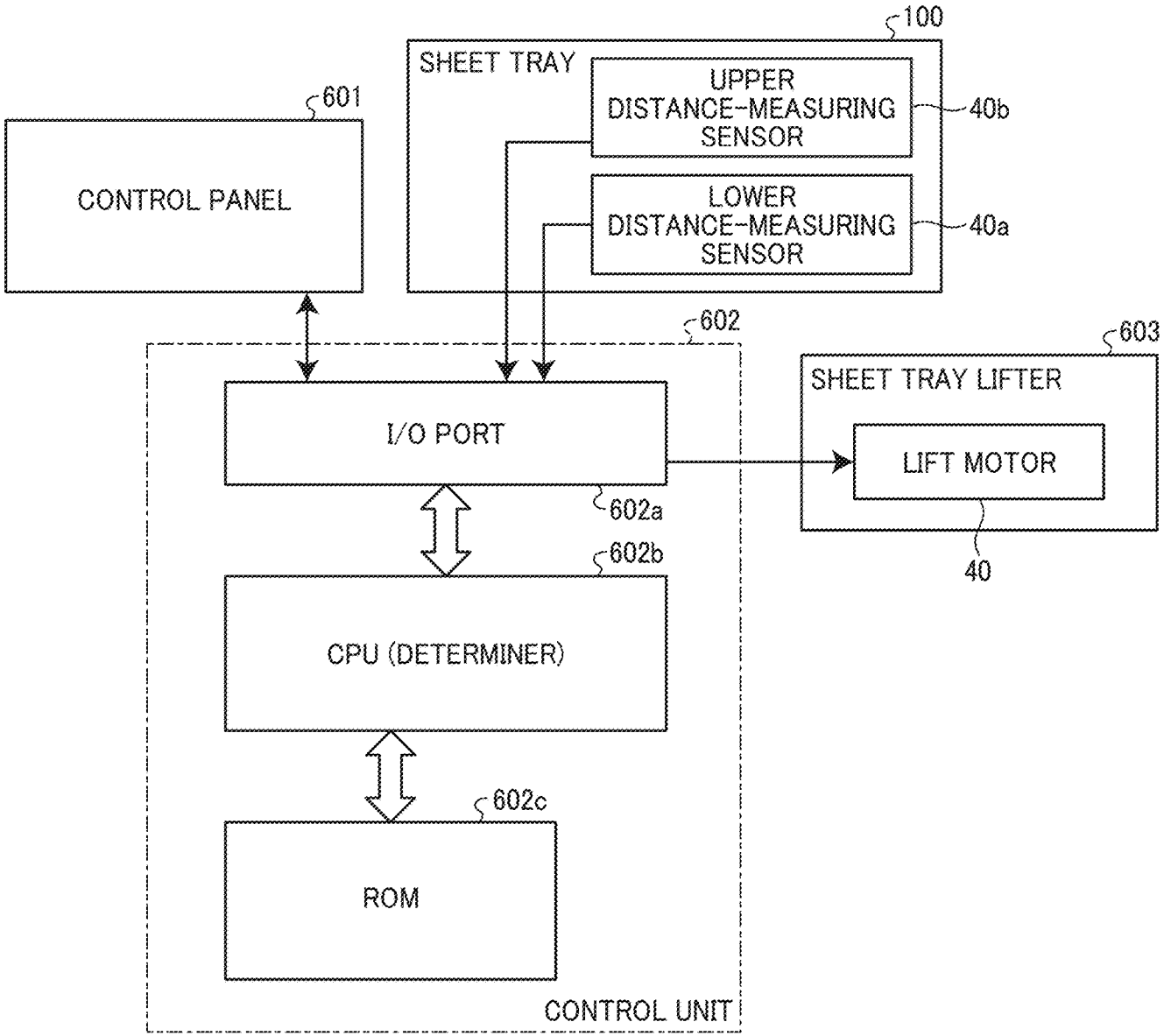
FIG. 6 is a diagram illustrating a hardware configuration of the sheet feeder of FIGS. 2A and 2B, according to the first embodiment of the present disclosure.

FIG. 6 is a diagram illustrating a hardware configuration of the sheet feeder 210 of the image forming system 200 according to the first embodiment of the present disclosure.

Specifically, FIG. 6 is a schematic diagram illustrating the hardware configuration of the sheet feeder 210, to determine whether the distance between the right sheet-side restricting member 33*a* and the left sheet-side restricting member 33*b* is adequate. In the present embodiment, as illustrated in FIG. 6, the sheet feeder 210 includes a control panel 601, the sheet tray 100, a controller 602, and a sheet-tray lifter 603.

The lower distance-measuring sensor 40*a* and the upper distance-measuring sensor 40*b* are attached to lower and upper portions, respectively, of the rear-end restricting member 4 in the sheet tray 100, to measure distances to the right sheet-side restricting member 33*a* and the left sheet-side restricting member 33*b*. The control panel 601 receives input of setting information of sheet data, for example, a sheet-width size, and displays the alert to request readjustment of the distance between the right sheet-side restricting member 33*a* and the left sheet-side restricting member 33*b*. The lifting motor 40 lifts or lower the lift table 5. The lower distance-measuring sensor 40*a* and the upper distance-measuring sensor 40*b*, the control panel 601, and the lifting motor 40 are electrically connected to the controller 602 and controlled by the controller 602.

The controller 602 includes, for example, an input and output (I/O) port 602*a*, a central processing unit (CPU) 602*b*, and a read-only memory (ROM) 602*c*. The CPU 602*b* of the controller 602 determines whether the distance between the right sheet-side restricting member 33*a* and the left sheet-side restricting member 33*b* is adequate based on, for example, the measurement values of the lower distance-measuring sensor 40*a* and the upper distance-measuring sensor 40*b*, sheet data displayed on the control panel 601, sheet-size data and the allowable range of distance data stored in the ROM 602*c*. Subsequently, based on the above-described determination result, the CPU 602*b* causes the control panel 601 to display the alert to request readjustment of the distance between the right sheet-side restricting member 33*a* and the left sheet-side restricting member 33*b* and outputs an instruction to start lifting the lift table 5 to the lifting motor 40.

Specifically, the CPU 602*b* serves as or functions as a determiner that compares the first-measurement value, i.e., the measurement result of the first distance, with the second-measurement value, i.e., the measurement result of the second distance, to determine whether the distance between the right sheet-side restricting member 33*a* and the left sheet-side restricting member 33*b* is adequate. Specifically, when the first-measurement value is equal to or greater than the second-measurement value, the CPU 602*b* determines that the distance between the right sheet-side restricting member 33*a* and the left sheet-side restricting member 33*b* is adequate. Accordingly, in the sheet feeder 210 that feeds the recording media 8 after the lift table 5 is lifted and the recording media 8 are moved to the vicinity of the suction conveyor, the clearances between the right sheet-side restricting member 33*a* and the left sheet-side restricting member 33*b* and the lateral sides of the recording media 8 in the vicinity of the suction conveyor can be adequately secured, even if the clearances between the right sheet-side restricting member 33*a* and the left sheet-side restricting member 33*b* and the lateral sides of the recording media 8 are adjusted when the recording media 8 are stacked. At the same time, unnecessary friction between the left sheet-side restricting member 33*a* and the left sheet-side restricting member 33*b* and the lateral sides of the recording media 8 can be prevented from being generated, and the time to start over the operation can be reduced.

In the present embodiment, the CPU 602*b* determines whether the distance between the right sheet-side restricting member 33*a* and the left sheet-side restricting member 33*b* is adequate before the lift table 5 is lifted. Accordingly, the CPU 602*b* determines whether the distance between the right sheet-side restricting member 33*a* and the left sheet-side restricting member 33*b* is adequate before the lift table 5 is lifted. By so doing, the occurrence of downtime can be prevented and the operation time to readjust the distance between the right sheet-side restricting member 33*a* and the left sheet-side restricting member 33*b* can be minimized.

Figure 7:
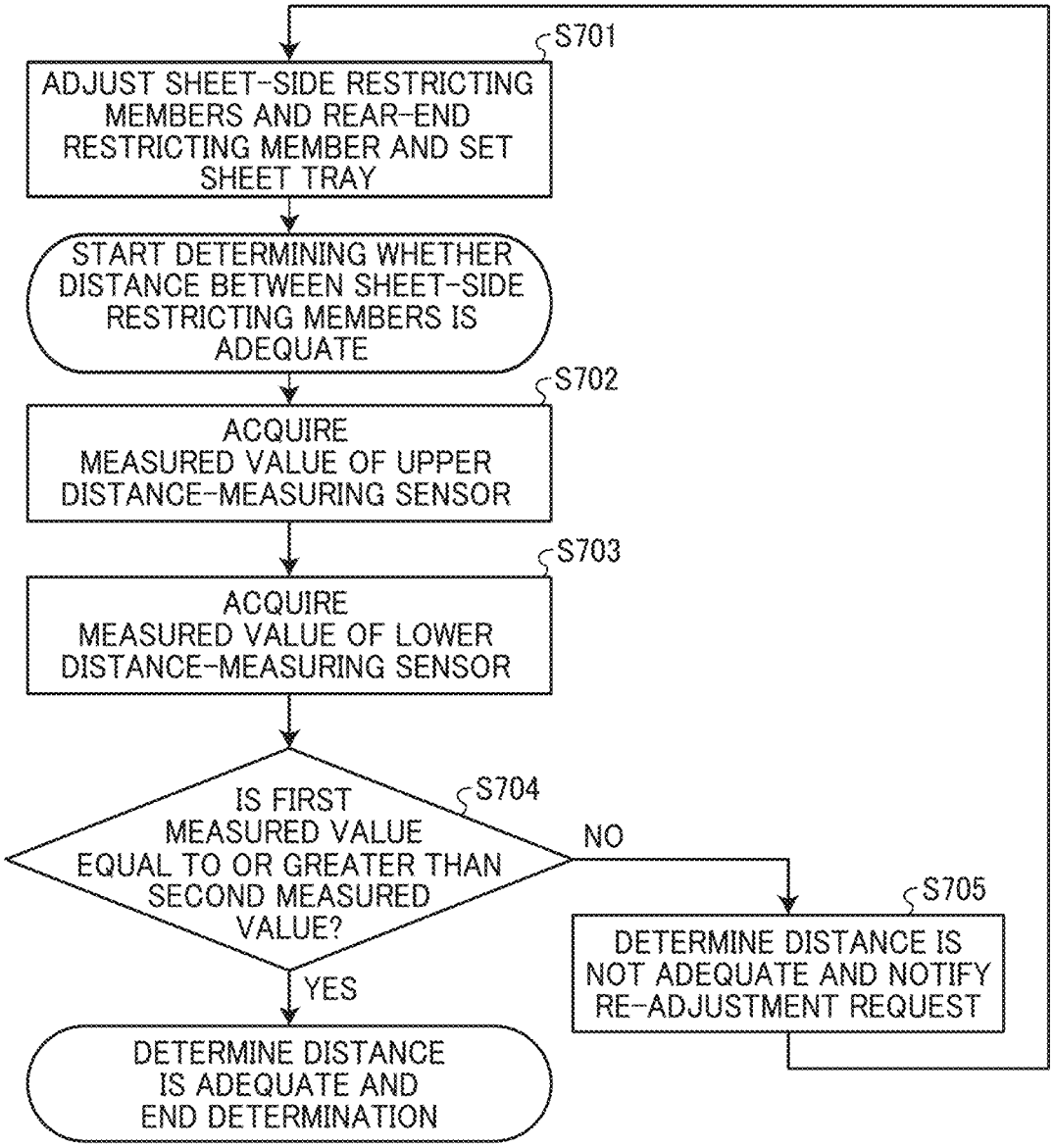
FIG. 7 is a flowchart of a procedure for determining whether the distance between sheet-side restricting members is adequate in the sheet feeder of the image forming system of FIG. 1, according to the first embodiment of the present disclosure.

FIG. 7 is a flowchart of a procedure for determining whether the distance between the right sheet-side restricting member 33*a* and the left sheet-side restricting member 33*b* is adequate in the sheet feeder 210 of the image forming system 200, according to the first embodiment of the present disclosure.

In the present embodiment, when the positions of the right sheet-side restricting member 33*a*, the left sheet-side restricting member 33*b*, and the rear-end restricting member 4 are adjusted in accordance with the recording media 8 such as stacked sheets of paper stacked on the sheet tray 100 and the sheet tray 100 is set (step S701), the CPU 602*b* starts processing to determine whether the distance between the right sheet-side restricting member 33*a* and the left sheet-side restricting member 33*b* is adequate. In the present embodiment, it is assumed that the right sheet-side restricting member 33*a* and the left sheet-side restricting member 33*b* contact against the lateral sides of the stacked recording media 8 to adjust the distance between the right sheet-side restricting member 33*a* and the left sheet-side restricting member 33*b*.

First, the CPU 602*b* acquires the first-measurement value measured by the upper distance-measuring sensor 40*b* (step S702). The CPU 602*b* acquires the second-measurement value measured by the lower distance-measuring sensor 40*a* (step S703). Subsequently, the CPU 602*b* determines whether the first-measurement value measured by the upper distance-measuring sensor 40*b* is equal to or greater than the second-measurement value measured by the lower distance-measuring sensor 40*a*. In other words, the CPU 602*b* determines whether the distance between the right sheet-side restricting member 33*a* and the left sheet-side restricting member 33*b* at upper sides of the right sheet-side restricting member 33*a* and the left sheet-side restricting member 33*b* is greater than the distance between the right sheet-side restricting member 33*a* and the left sheet-side restricting member 33*b* at lower sides of the right sheet-side restricting member 33*a* and the left sheet-side restricting member 33*b* (step S704).

When the first-measurement value is equal to or greater than the second-measurement value (YES in step S704), the CPU 602*b* determines that the friction between the right sheet-side restricting member 33*a* and the left sheet-side restricting member 33*b* and the lateral sides of the recording media 8 does not increase when the recording media 8 are floated and sucked and conveyed even after the lift table 5 has been lifted. In such cases, the CPU 602*b* determines that the distance between the right sheet-side restricting member 33*a* and the left sheet-side restricting member 33*b* is adequate. Alternatively, when the first-measurement value is smaller than the second-measurement value (NO in step S704), the CPU 602*b* determines that the distance between the right sheet-side restricting member 33*a* and the left sheet-side restricting member 33*b* is inadequate. Then, the CPU 602*b* displays an alert on the control panel 601 to request readjustment of the positions of the right sheet-side restricting member 33*a* and the left sheet-side restricting member 33*b* (step S705).

Figure 8:
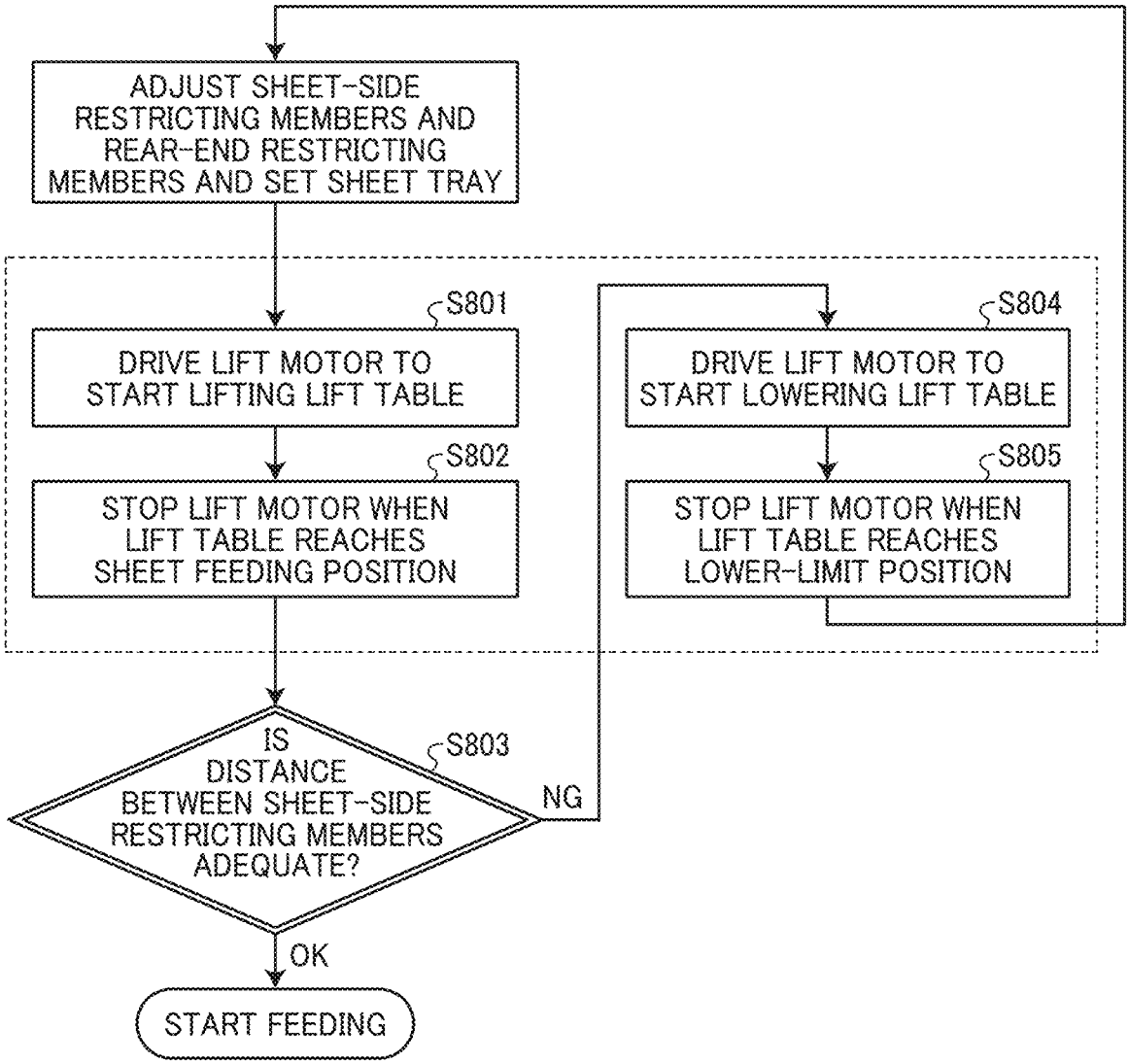
FIG. 8 is a flowchart of a procedure for driving a lift table in a sheet feeder in the related art.

FIG. 8 is a flowchart of a procedure for driving a lift table in a sheet feeder in the related art.

When the positions of a right sheet-side restricting member and a left sheet-side restricting member and a rear-end restricting member are adjusted and a sheet tray is set, the sheet feeder in the related art lifts a lift table by a lifting motor (step S801) and stops the lifting motor when the lift table reaches a position at which recording media are fed (step S802).

Subsequently, the sheet feeder in the related art determines whether the distance between the right sheet-side restricting member and the left sheet-side restricting member is adequate (step S803). When the distance between the right sheet-side restricting member and the left sheet-side restricting member is adequate (YES in step S803), the sheet feeder in the related art starts feeding the recording media. Alternatively, when the distance between the right sheet-side restricting member and the left sheet-side restricting member is inadequate (NO in step S803), the sheet feeder in the related art lowers the lift table by the lifting motor (step S804) and stops the lifting motor when the lift table reaches a lower-limit position (step S805).

Figure 9:
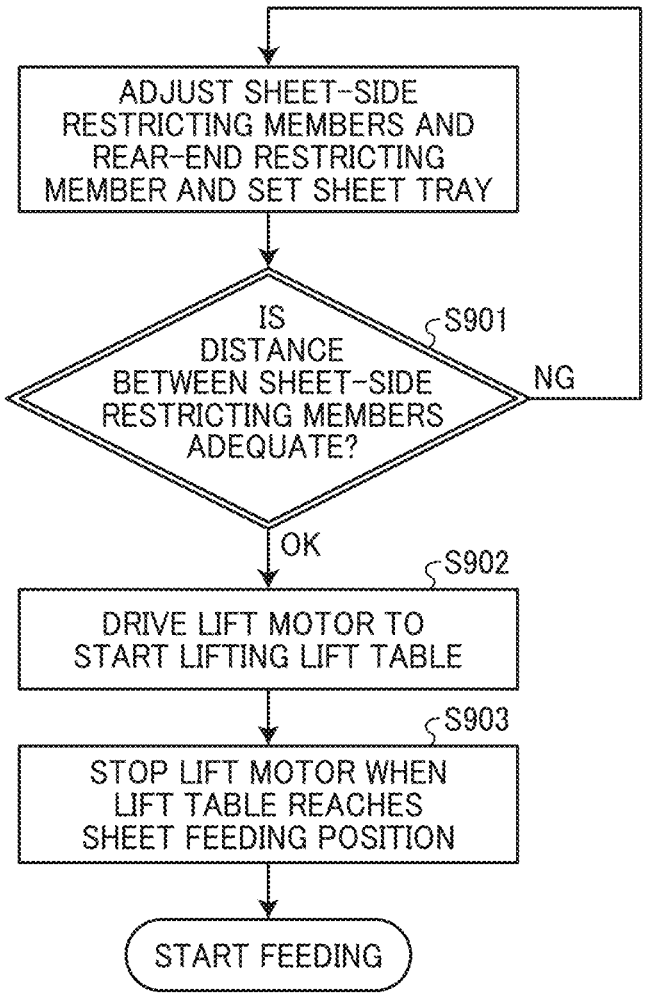
FIG. 9 is a flowchart of a procedure for driving a lift table in the sheet feeder of the image forming system of FIG. 1, according to the first embodiment of the present disclosure.

FIG. 9 is a flowchart of a procedure for driving the lift table 5 in the sheet feeder 210 of the image forming system 200, according to the first embodiment of the present disclosure.

When the positions of the right sheet-side restricting member 33*a*, the left sheet-side restricting member 33*b*, and the rear-end restricting member 4 are adjusted and the sheet tray 100 is set, the CPU 602*b* determines whether the distance between the right sheet-side restricting member 33*a* and the left sheet-side restricting member 33*b* is adequate by the above-described determination processing (step S901). When the distance between the right sheet-side restricting member 33*a* and the left sheet-side restricting member 33*b* is inadequate (NO in step S901), the CPU 602*b* waits until the positions of the right sheet-side restricting member 33*a*, the left sheet-side restricting member 33*b*, and the rear-end restricting member 4 are adjusted and the sheet tray 100 is set.

Alternatively, when the distance between the right sheet-side restricting member 33*a* and the left sheet-side restricting member 33*b* is adequate (YES in step S901), the CPU 602*b* lifts the lift table 5 by the lifting motor 40 (step S902). When the lift table 5 reaches a position at which the recording medium 8 is fed, the CPU 602*b* stops the lifting motor 40 (step S903). Subsequently, the CPU 602*b* starts feeding the recording medium 8.

When the distance between the right sheet-side restricting member 33*a* and the left sheet-side restricting member 33*b* is adequate, there is no difference between the time in driving the lift table of the sheet feeder in the related art and the time in driving the lift table 5 of the sheet feeder 210 of the present embodiment. However, when it is determined that the distance between the right sheet-side restricting member 33*a* and the left sheet-side restricting member 33*b* is inadequate, in the sheet feeder in the related art, an extra operation time is needed for lifting and lowering the lift table. By contrast, in the sheet feeder 210 according to the present embodiment, it is determined whether the distance between the right sheet-side restricting member 33*a* and the left sheet-side restricting member 33*b* is adequate before the lift table 5 is driven. Accordingly, the occurrence of downtime can be prevented and the operation time for readjusting the distance between the right sheet-side restricting member 33*a* and the left sheet-side restricting member 33*b* can be minimized.

As described above, the sheet feeder 210 of the image forming system 200 according to the first embodiment feeds the recording medium 8 after the lift table 5 is lifted to move the recording media 8 to the vicinity of the suction conveyor. Such a configuration as described above allows the clearances between the right sheet-side restricting member 33*a* and the left sheet-side restricting member 33*b* and the lateral sides of the recording media 8 in the vicinity of the suction conveyor to be adequately secured, even if the clearances between the right sheet-side restricting member 33*a* and the left sheet-side restricting member 33*b* and the lateral sides of the recording media 8 are adjusted at the time at which the recording media 8 are stacked. As a result, unnecessary friction between the right sheet-side restricting member 33*a* and the left sheet-side restricting member 33*b* and the lateral sides of the recording media 8 can be prevented from being generated and the time to start over the operation can be reduced.

Second Embodiment

In a second embodiment of the present disclosure, the CPU 602*b* determines that the distance between the right sheet-side restricting member 33*a* and the left sheet-side restricting member 33*b* is adequate even when the first-measurement value is smaller than the second-measurement value, if the first-measurement value is greater than the sheet-width size set in advance by an operator. In the following description, the description of configurations of the second embodiment similar to the configurations of the first embodiment are omitted.

In the present embodiment, if the first-measurement value is greater than the sheet-width size even when the first-measurement value is smaller than the second-measurement value, the CPU 602*b* determines that the distance between the right sheet-side restricting member 33*a* and the left sheet-side restricting member 33*b* is adequate. Accordingly, if the first-measurement value of the upper distance-measuring sensor 40*b* is greater than the preset sheet-width size even when the first-measurement value of the upper distance-measuring sensor 40*b* is smaller than the second-measurement value of the lower distance-measuring sensor 40*a*, an option in which the adjustment of the distance between the right sheet-side restricting member 33*a* and the left sheet-side restricting member 33*b* is allowed can be selected. In so doing, an unnecessary operation to readjust the distance between the right sheet-side restricting member 33*a* and the left sheet-side restricting member 33*b* can be avoided.

Figure 10:
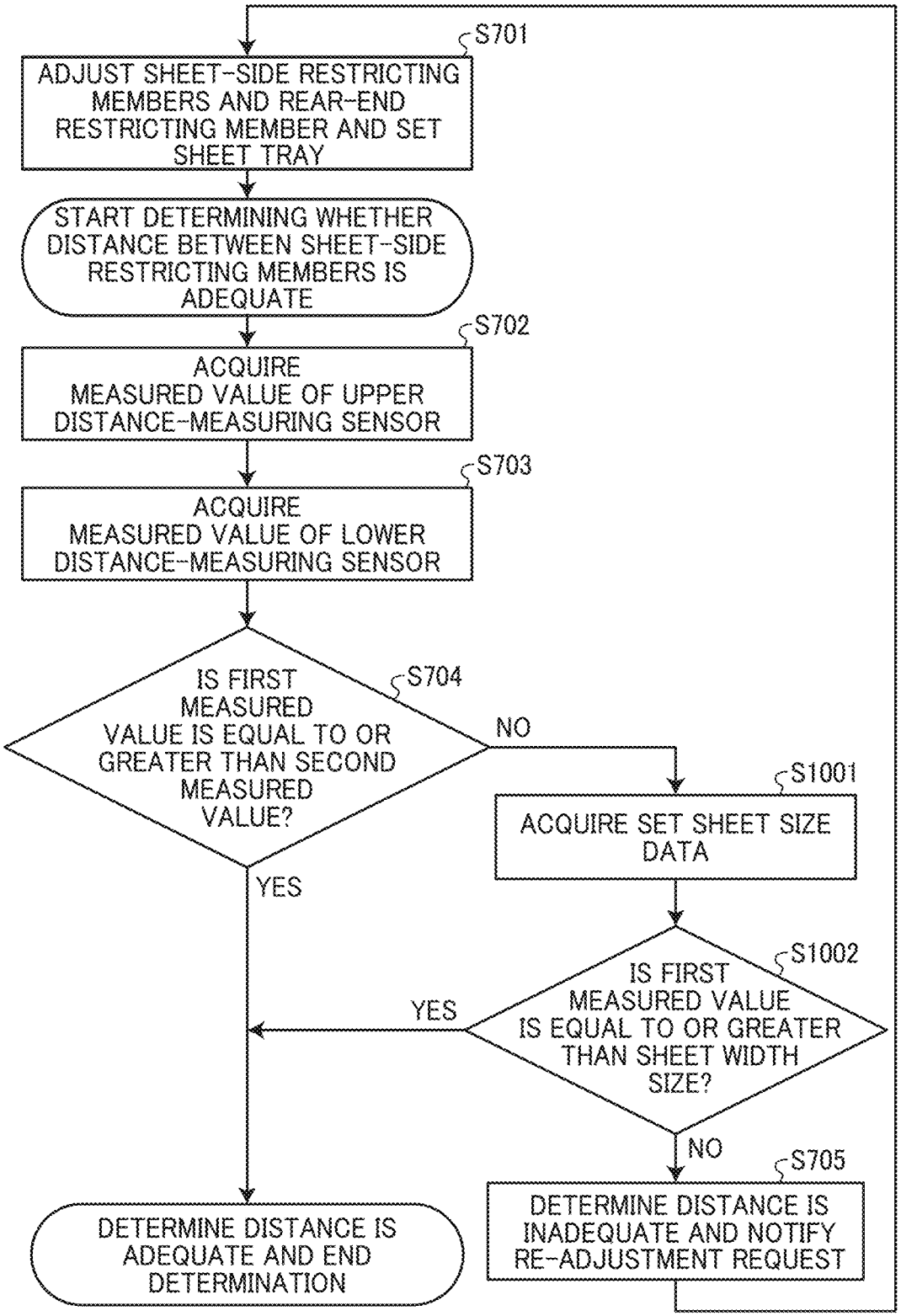
FIG. 10 is a flowchart of a procedure for determining whether the distance between sheet-side restricting members is adequate in a sheet feeder of the image forming system of FIG. 1, according to a second embodiment of the present disclosure.

FIG. 10 is a flowchart of a procedure for determining whether the distance between the right sheet-side restricting member 33*a* and the left sheet-side restricting member 33*b* is adequate in the sheet feeder 210 of the image forming system 200, according to the second embodiment of the present disclosure.

In the following description, the description of processing similar to the processing illustrated in FIG. 7 is omitted.

When the first-measurement value is smaller than the second-measurement value (NO in step S704), the CPU 602*b* acquires sheet-size data indicating the sheet-width size set in advance by the operator (step S1001). Subsequently, the CPU 602*b* determines whether the first-measurement value is equal to or greater than the sheet-width size indicated by the sheet-size data (step S1002).

When the first-measurement value is equal to or greater than the sheet width size (YES in step S1002), the CPU 602*b* determines that the distance between the right sheet-side restricting member 33*a* and the left sheet-side restricting member 33*b* is greater than the set sheet-width size, i.e., the sheet width of the stacked recording media 8 and that the friction between the right sheet-side restricting member 33*a* and the left sheet-side restricting member 33*b* and the lateral sides of the recording media 8 does not increase when the recording media 8 are floated and sucked and conveyed even after the lift table 5 is lifted. For this reason, the CPU 602*b* determines that the distance between the right sheet-side restricting member 33*a* and the left sheet-side restricting member 33*b* is adequate. Alternatively, when the first-measurement value is smaller than the sheet-width size (NO in step S1002), the CPU 602*b* determines that the distance between the right sheet-side restricting member 33*a* and the left sheet-side restricting member 33*b* is inadequate and displays the alert to request readjustment of the distance between the right sheet-side restricting member 33*a* and the left sheet-side restricting member 33*b* on the control panel 601 (step S705).

As described above, in the sheet feeder 210 of the image forming system 200 according to the second embodiment, if the first-measurement value of the upper distance-measuring sensor 40*b* is greater than the sheet-width size set in advance even when the first-measurement value of the upper distance-measuring sensor 40*b* is smaller than the second-measurement value of the lower distance-measuring sensor 40*a*, an option in which the adjustment of the distance between the right sheet-side restricting member 33*a* and the left sheet-side restricting member 33*b* is allowed can be selected. In so doing, an unnecessary operation to readjust the distance between the right sheet-side restricting member 33*a* and the left sheet-side restricting member 33*b* can be avoided.

Third Embodiment

In a third embodiment of the present disclosure, the CPU 602*b* determines that the distance between the right sheet-side restricting member 33*a* and the left sheet-side restricting member 33*b* is adequate when the first-measurement value is equal to or greater than the second-measurement value and the difference between the first-measurement value and the second-measurement value falls within the allowable range or when the difference between the first-measurement value and the sheet-width size set in advance falls within the allowable range. In the following description, the description of configurations of the third embodiment similar to the configuration of the above-described embodiments is omitted.

In the present embodiment, the CPU 602*b* determines that the distance between the right sheet-side restricting member 33*a* and the left sheet-side restricting member 33*b* is adequate when the first-measurement value is equal to or greater than the second-measurement value and the difference between the first-measurement value and the second-measurement value falls within the allowable range or when the difference between the first-measurement value and a sheet-width size set in advance falls within the allowable range, which is, for example, greater than 0 mm and equal to or smaller than 2 mm which is an example of a predetermined value. Accordingly, a disadvantage related to the recording media 8, for example, the occurrence of skew of the recording media 8, which is caused when the clearances between the right sheet-side restricting member 33*a* and the left sheet-side restricting member 33*b* and the lateral sides of recording media 8 are excessively large, can be prevented.

Figure 11:
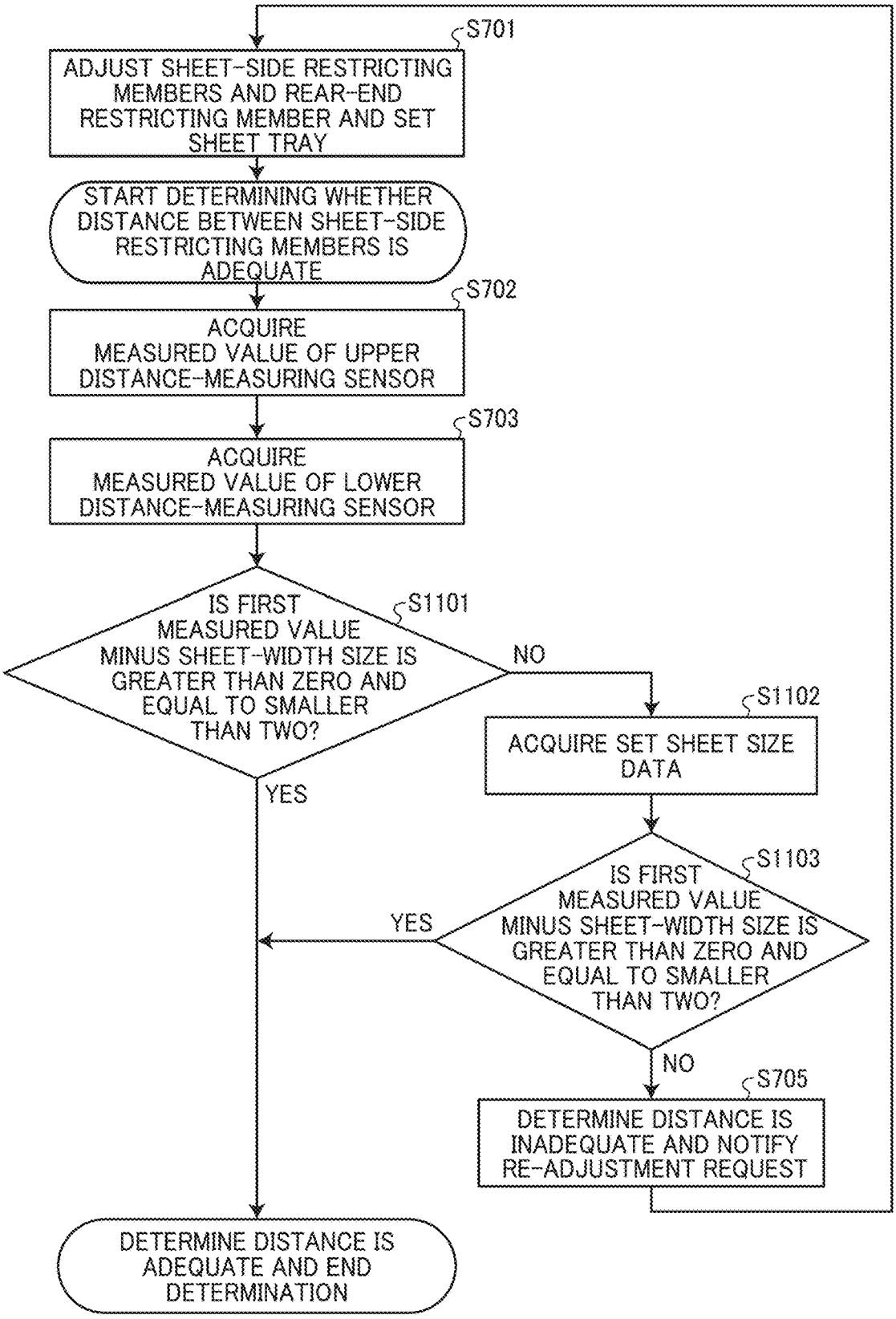
FIG. 11 is a flowchart of a procedure for determining whether the distance between sheet-side restricting members is adequate in a sheet feeder of the image forming system of FIG. 1, according to a third embodiment of the present disclosure.

FIG. 11 is a flowchart of a procedure for determining whether the distance between the right sheet-side restricting member 33*a* and the left sheet-side restricting member 33*b* is adequate in the sheet feeder 210 of the image forming system 200, according to the third embodiment of the present disclosure.

In the following description, the description of processing similar to the processing illustrated in FIG. 7 is omitted.

The CPU 602*b* determines whether a difference obtained by subtracting the second-measurement value from the first-measurement value is greater than 0 mm and equal to or smaller than a predetermined value, for example, 2 mm, in other words, whether the first-measurement value is equal to or greater than the second-measurement value and the above-described difference is greater than 0 mm and equal to or smaller than the predetermined value (step S1101).

When the difference obtained by subtracting the second-measurement value from the first-measurement value is greater than 0 mm and equal to or smaller than the predetermined value (YES in step S1101), the friction between the right sheet-side restricting member 33*a* and the left sheet-side restricting member 33*b* and the lateral sides of the recording media 8 does not increase when the recording media 8 are floated and sucked and conveyed even after the lift table 5 is lifted. In such a case, the distance between the right sheet-side restricting member 33*a* and the left sheet-side restricting member 33*b* falls within a certain range, i.e., the allowable range. Accordingly, the CPU 602*b* determines that the skew of the recording media 8 does not occur and the distance between the right sheet-side restricting member 33*a* and the left sheet-side restricting member 33*b* is adequate.

Alternatively, when the difference obtained by subtracting the second-measurement value from the first-measurement value is not in the range of greater than 0 mm and equal to or smaller than the predetermined value (NO in step S1101), the CPU 602*b* acquires the sheet-size data indicating the sheet-width size set in advance by the operator (step S1102). Subsequently, the CPU 602*b* determines whether a difference obtained by subtracting the sheet-width size from the first-measurement value is greater than 0 mm and equal to or smaller than the predetermined value (step S1103). When the CPU 602*b* determines that the difference obtained by subtracting the sheet-width size from the first-measurement value is greater than 0 mm and equal to or smaller than the predetermined value (YES in step S1103), the CPU 602*b* determines that the distance between the right sheet-side restricting member 33*a* and the left sheet-side restricting member 33*b* is adequate. Alternatively, when the CPU 602*b* determines that the above-described difference is not in the range of greater than 0 mm and equal to or smaller than the predetermined value (NO in step S1103), the CPU 602*b* determines that the distance between the right sheet-side restricting member 33*a* and the left sheet-side restricting member 33*b* is inadequate and displays the alert to request readjustment of the distance between the right sheet-side restricting member 33*a* and the left sheet-side restricting member 33*b* on the control panel 601 (step S705).

As described above, in the sheet feeder 210 of the image forming system 200 according to the third embodiment, a disadvantage related to the recording media 8, for example, the occurrence of skew of the recording media 8, caused when the clearances between the right sheet-side restricting member 33*a* and the left sheet-side restricting member 33*b* and the lateral sides of recording media 8 are excessively large, can be prevented. Aspects of the present disclosure are, for example, as follows.

First Aspect

A sheet feeder according to a first aspect includes a lift table on which sheets are stacked, a first sheet-side restricting member, a second sheet-side restricting member, a suction conveyor, a rear-end restricting member, an upper distance-measuring sensor, a lower distance-measuring sensor, and a determiner.

The lift table is movable in a vertical direction. The first sheet-side restricting member restricts first ends of the sheets stacked on the lift table in a width direction of the sheets. The second sheet-side restricting member restricts second ends of the sheets opposite to the first ends of the sheets in the width direction of the sheets. The suction conveyor sucks and conveys a sheet floated from the lift table after the lift table is lifted. The rear-end restricting member is disposed at a center portion of the sheets in the width direction of the sheets, to restrict the sheets stacked on the lift table from moving in a longitudinal direction of the sheets. The upper distance-measuring sensor is disposed at an upper portion of the rear-end restricting member, to measure a first distance to the first sheet-side restricting member or the second sheet-side restricting member. The lower distance-measuring sensor is disposed at a lower portion of the rear-end restricting member, to measure a second distance to the first sheet-side restricting member or the second sheet-side restricting member. The determiner compares a measurement result of the first distance with a measurement result of the second distance to determine whether a distance between the first sheet-side restricting member and the second sheet-side restricting member is adequate.

Second Aspect

In the sheet feeder according to the first aspect, the determiner determines that the distance between the first sheet-side restricting member and the second sheet-side restricting member is adequate when the first distance is equal to or greater than the second distance.

Third Aspect

In the sheet feeder according to the first aspect or the second aspect, the determiner determines that the distance between the first sheet-side restricting member and the second sheet-side restricting member is adequate when the first distance is smaller than the second distance and the first distance is greater than a sheet-width size set in advance by an operator.

Fourth Aspect

In the sheet feeder according to any one of the first to third aspects, the determiner determines whether the distance between the first sheet-side restricting member and the second sheet-side restricting member is adequate before the lift table is lifted.

Fifth Aspect

In the sheet feeder according to the first aspect or the fourth aspect, the determiner determines that the distance between the first sheet-side restricting member and the second sheet-side restricting member is adequate when the first distance is equal to or greater than the second distance and a difference between the first distance and the second distance falls within an allowable range or when a difference between the first distance and a sheet-width size set in advance by an operator falls within an allowable range.

Sixth Aspect

In the sheet feeder according to any one of the first to fifth aspects, the first sheet-side restricting member and the second sheet-side restricting member move in conjunction with each other in the width direction of the sheets.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A sheet feeder comprising:

a lift table on which sheets are stacked, the lift table being movable in a vertical direction;

a first sheet-side restricting member configured to restrict first ends of the sheets stacked on the lift table in a width direction of the sheets;

a second sheet-side restricting member configured to restrict second ends of the sheets opposite to the first ends of the sheets in the width direction of the sheets;

a suction conveyor configured to suck and convey a sheet floated from the lift table after the lift table is lifted;

a rear-end restricting member at a center portion of the sheets in the width direction of the sheets, the rear-end restricting member configured to restrict the sheets stacked on the lift table from moving in a longitudinal direction of the sheets;

an upper distance-measuring sensor at an upper portion of the rear-end restricting member, the upper distance-measuring sensor configured to measure a first distance to the first sheet-side restricting member or the second sheet-side restricting member;

a lower distance-measuring sensor at a lower portion of the rear-end restricting member, the lower distance-measuring sensor configured to measure a second distance to the first sheet-side restricting member or the second sheet-side restricting member; and processing circuitry configured to compare a measurement result of the first distance with a measurement result of the second distance to determine whether a distance between the first sheet-side restricting member and the second sheet-side restricting member is within a threshold.

2. The sheet feeder according to claim 1, wherein the processing circuitry is configured to determine that the distance between the first sheet-side restricting member and the second sheet-side restricting member is within the threshold in response to the first distance being equal to or greater than the second distance.

3. The sheet feeder according to claim 1, wherein the processing circuitry is configured to determine that the distance between the first sheet-side restricting member and the second sheet-side restricting member is within the threshold in response to the first distance being smaller than the second distance and the first distance being greater than a set sheet-width size.

4. The sheet feeder according to claim 1, wherein the processing circuitry is configured to determine whether the distance between the first sheet-side restricting member and the second sheet-side restricting member is within the threshold before the lift table is lifted.

5. The sheet feeder according to claim 1, wherein the processing circuitry is configured to determine that the distance between the first sheet-side restricting member and the second sheet-side restricting member is within the threshold in response to the first distance being equal to or greater than the second distance and a difference between the first distance and the second distance being within a range, or a difference between the first distance and a set sheet-width size being within the range.

6. The sheet feeder according to claim 1, wherein the first sheet-side restricting member and the second sheet-side restricting member are configured to move in conjunction with each other in the width direction of the sheets.

* * * * *